US006860414B2

(12) United States Patent
Solignac

(10) Patent No.: US 6,860,414 B2
(45) Date of Patent: Mar. 1, 2005

(54) FILLING HEAD

(76) Inventor: Jean-Pierre Solignac, 10, Rue du Truc d'Anis, F-34270 Saint Mathieu de Treviers (FR)

( * ) Notice: Subject to any disclaimer, the term of this patent is extended or adjusted under 35 U.S.C. 154(b) by 0 days.

(21) Appl. No.: 10/469,403

(22) PCT Filed: Mar. 4, 2002

(86) PCT No.: PCT/FR02/00771

§ 371 (c)(1),
(2), (4) Date: Mar. 24, 2004

(87) PCT Pub. No.: WO02/070395

PCT Pub. Date: Sep. 12, 2002

(65) Prior Publication Data

US 2004/0149784 A1 Aug. 5, 2004

(30) Foreign Application Priority Data

Mar. 2, 2001 (FR) ..... 01 03349

(51) Int. Cl.[7] ..... B67C 3/26

(52) U.S. Cl. ..... 222/504; 222/509; 222/518; 251/262; 251/263

(58) Field of Search ..... 222/504, 509, 222/518; 251/262, 263

(56) References Cited

U.S. PATENT DOCUMENTS

| | | | | | |
|---|---|---|---|---|---|
| 722,738 | A | | 3/1903 | Mendham | |
| 992,375 | A | * | 5/1911 | Moffitt | 251/229 |
| 1,048,825 | A | * | 12/1912 | Griffiths | 251/229 |
| 3,601,162 | A | | 8/1971 | Page et al. | |
| 3,926,229 | A | | 12/1975 | Scholle | |
| 4,319,613 | A | | 3/1982 | Mette | |
| 4,728,077 | A | * | 3/1988 | Takahashi | 251/257 |
| 4,750,311 | A | | 6/1988 | Catelli | |
| 5,096,098 | A | * | 3/1992 | Garcia | 222/402.13 |
| 5,150,743 | A | | 9/1992 | Walusiak | |
| 5,360,172 | A | * | 11/1994 | Wang | 239/586 |
| 5,699,933 | A | * | 12/1997 | Ho et al. | 220/703 |
| 6,296,157 | B1 | * | 10/2001 | Erb | 222/509 |
| 6,360,925 | B2 | * | 3/2002 | Erb | 222/509 |

FOREIGN PATENT DOCUMENTS

| | | |
|---|---|---|
| EP | 0 274 154 | 7/1988 |
| EP | 0 345 685 | 12/1989 |
| FR | 1.482.108 | 4/1966 |
| GB | 2 234 499 | 2/1991 |

* cited by examiner

*Primary Examiner*—Kenneth Bomberg
(74) *Attorney, Agent, or Firm*—Young & Thompson

(57) ABSTRACT

A device for distributing and dosing pasty, liquid, semi-liquid or pulverulent products comprises a valve body which is provided with a through channel for moving the product from a feed opening to a delivery nozzle in dosed quantities. A valve seat is formed in the channel and a valve is mounted in the channel. The product through channel comprises a rectilinear product, passage segment in which the valve seat is disposed and in which the valve and the valve rod extend axially and in full. Moreover, the valve drive mechanism penetrates the product passage segment at least in part. The drive mechanism is in contact with the product such that the mechanical link between the valve rod and the drive mechanism is also in contact with the product and is lubricated by the product.

25 Claims, 3 Drawing Sheets

FILLING HEAD

The present invention has for its object a device for dispensing and measuring with precision pasty products with high or low surface tension, that can be used also for the measured dispensing of liquid or semi-liquid products with high or low surface tension or else powdered products with high or low power of agglomeration.

The cosmetological, pharmaceutical, chemical and other industries require very high degrees of precision of the order of a half milligram, for measuring different constituents entering into various compositions. The manual production of these compositions with the required precision is particularly long and fastidious and is incompatible with mass production. Another defect of the manual methods is that they can give rise to multiple errors of measurement or of composition.

The state of the art proposes numerous solutions for the automation of the production of various compositions. Thus there are known devices for the dispensing in measured quantities of liquids, with which it is possible to make various compositions in an automated way. These devices are specifically designed for the dispensing and measuring of liquid or semi-liquid products, and are less useful in the measured dispensing of pasty products with high surface tension as well as the measured dispensing of pulverulent products. A device of this type is particularly known from the patent EP0 929 498 of the applicant. This device has the advantage over those of the prior art, of measuring the products with a precision of the order of a half milligram.

There are also known devices for the dispensing in measured quantities of pulverulent products. One of the drawbacks of these devices resides in the fact that they cannot be used for measuring liquids or pasty products. Moreover, their lack of precision limits their field of application. Patent application WO 98/35896 of the applicant provides an effective solution to the lack of precision, however this device can distribute only pulverulent products.

There are also known devices for the dispensing of pasty products. If it is possible to use certain of them for the distribution of liquids, their principal drawback resides in their lack of precision. This arises essentially from the fact that the surface tension of these pasty products hinders the free flow of the product stream, this latter being generally in the form of more or less long and more or less thick filaments. These product streams, of variable weights from one dispensing operation to the other, remain, in most cases, suspended from the dispensing nozzle. It is thus important to separate the measured stream from the distribution nozzle to complete the measurement and to ensure the precision of this latter. It has been proposed to use cutting or scraping members to ensure this separation, but the use of such elements in no way solves the problem, the surface tension of the pasty product being such that the measured stream remains attached to these members. Dispensing by weighing the receptacle into which the product is poured, could be practiced. But because of the random adherence of the tail end of the material to the distribution nozzle, the precision of measurement could be thrown off by the untimely fall of this tail of material into the receptacle. The dispensed tail could also be attacked by blowing, to avoid its falling into the receptacle, but such a solution can be adopted only for effluent products of low cost. For particularly costly products, such as those based on essential oils, used in the field of perfumery or containing active principles like those used in the field of cosmetology or pharmacology, such a solution would give rise to substantial financial loss and for certain types of products, a substantial pollution of the environment immediately adjacent the dispensing station.

The same problems arise to a lesser degree for the measured dispensing of liquid or semi-liquid products. For such products, the end of the dose is generally present in the form of more or large drops.

The requirement for very high precision of the order of half a milligram, particularly for the measuring of pasty products, is at present incompatible with a high rate of production. Thus, the principal parameter which directly influences the rate of production is the value of dispensed flow rate of these products. A high flow rate implies with present apparatus, high speeds of flow which increase greatly the kinetic energy of the flow. It should be noted that for precision measurement, the receptacle adapted to receive the flow is disposed on a precision balance whose measurement can be greatly disturbed by abrupt dissipation of kinetic energy of the flow during impact of this latter on the receptacle or on the product already contained in this receptacle. The application has already solved this problem for weighing liquid and pulverulent products, but the solutions used are not useful for measuring pasty products.

Obtaining a high degree of precision of measurement presupposes a complete control of the degree of opening of the closure element of the measuring device. Typically in the known systems, this closure element is constituted by a valve whose stem coacts with an actuating mechanism. For close control of the degree of opening of the valve, the state of the art particularly teaches the use of actuating mechanism in the form of a screw and nut driven by the output shaft of a motor of the electrical type. Such means, although simple, themselves complicate the production of the measuring device.

The actuating mechanism of the valve, to operate correctly, is periodically lubricated. To avoid any pollution of the product to be delivered by lubricant fluids, the actuating mechanism is mounted in a chamber separated from the path of passage of the product into the device, by sealing elements. Such a solution commonly used complicates the production of the device without totally avoiding the risk of pollution because of necessary wear on the sealing elements.

Another factor that can affect the precision of measurement is the ease of flow of the product through the device. These devices with a valve (which is to say with a closure member movable perpendicularly to the seat) serve well if there is the possibility of precise adjustment of the flow whilst maintaining laminar flow, but correspondingly, the known valved devices involve a flow passage for the product, with a deflection particularly at the seat. These deflections are factors in pressure drop and for pasty products can constitute niches for retention of the product. Such a drawback does not take place in valved devices (which is to say with a closure member movable parallel to the seat) which permit the provision of a rectilinear passage. However, although the flow rate can be adjusted by suitable positioning of the valve, this type of configuration can lead downstream of the valve to turbulences which can transform laminar flow into turbulent flow, adapted to alter the precision of measurement.

Finally, the existence of high yield in the production of compositions from different products delivered in perfectly measured quantities, presupposes that the assembly of these products and their dispensing devices will be grouped within a same unit. These devices, for liquid and powder dispensing devices, are described in prior patents of the applicant. The interest in these prior arrangements is that they require but a single motor to actuate the different measuring devices, which with the associated product reservoirs, are mounted on a movable structure, for example a turning plate, to be brought into opposition with the actuating motor. This approach simplifies the production of the assembly, and facilitates its control. The attraction is to be able to use such an arrangement for dispensing devices for pasty products, but the valved devices of the prior art do not provide such an arrangement.

The present invention has for its object to solve the problem set forth above, by providing a universal device that can be used for the measured dispensing of all types of products whether pasty, liquid, semi-liquid or pulverulent, with which it is possible to obtain a very high degree of precision of measurement with mechanical means that are simple, strong and machined with tolerances now available.

Another object of the present invention is the use of a device for the dispensing and measuring of pasty products which permits marrying precision of measurement and rapidity of dispensing of the product.

Another object of the present invention is that production of device for the dispensing and measuring of pasty products whose closure member is constituted by a valve and for which the pressure loss has been reduced.

Another object of the present invention is the provision of a device for the dispensing and measuring of pasty, liquid or semi-liquid products with high surface tension or pulverulent products with a high power of agglomeration.

Another object of the present invention is to obtain a very high degree of precision in the measuring of pasty, liquid, semi-liquid and pulverulent products, this degree of precision being able to achieve a tenth of a milligram.

Another object of the present invention is the provision of a device for the dispensing and measuring of pasty, liquid or semi-liquid products with high surface tension or of pulverulent products with a high power of agglomeration, which ensures on the one hand the separation of the end of the dosage without the use of mechanical members such as scrapers and the like coming into contact with the product, and on the other hand the falling of this tail end of the dosage into the receptacle into which the dosage is dispensed.

To this end, the device for measured dispensing of pasty or liquid or semi-liquid or pulverulent products, comprises a device in whose body is formed a conduit for passage of the product from an inlet opening toward a fitting for delivering the product in measured quantities. A valve seat is formed in said conduit and the valve is mounted in this latter so as to be able to slide and be applied against the valve seat or be spaced from this latter so as either to prevent the dispensing of the product, or to permit this dispensing. The valve is provided with a valve stem which is mounted slidably in a guide bore and coats with a motor mechanism for actuating the valve by moving it toward or away from the valve seat. This device as defined, is characterized essentially in that the conduit for passage of the product comprises a rectilinear segment for passage of the product, in which segment is disposed the valve seat and extends axially and completely the valve and the valve stem and into which segment penetrates at least in part the valve actuating mechanism, this mechanism being in contact with the product such that the mechanical connection between the valve stem and the actuating mechanism will also be in contact with the product and will be lubricated by the product itself.

According to another characteristic of the invention, the actuating mechanism for a valve comprises, on the one hand at least one resilient member acting to press the valve and urging this latter toward the seat and hence toward a closed position, and on the other hand an actuating rod, guided axially in a bore of the body of this device, which bore is transverse to the rectilinear segment of the passage conduit and opens into said segment, said rod coming into contact with the valve stem by pressing on this latter, the contact between the valve stem and the actuating mechanism being established by two sliding surfaces of which one is provided on the valve stem and the other on the actuating rod, the two said surfaces being located in the rectilinear segment of passage for the product, and at least one of said surfaces being flat and oblique relative to the geometric axis of movement of the valve between its open and closed positions and oblique relative to the geometric axis of movement of the actuating rod, such that when the actuating rod is moved by a motor member in the direction to enter the body of the device, the valve will be spaced from its seat under the effect of the pressure exerted by the sliding surface of the actuating rod on the sliding surface of the valve stem.

There is thus provided a particularly simple and inexpensive actuating mechanism.

According to another characteristic of the invention, the oblique sliding surface forms with the geometric axis of movement of the actuating rod, an acute angle of a valve less than 45°. Thanks to this characteristic, a given movement of the actuating rod is accompanied by a lesser displacement of the valve. There is thus obtained a demultiplication effect of the movement of the valve, leading to better positional precision of this latter.

According to another characteristic of the invention, the guide bore for the actuating rod is perpendicular to the passage section of the product.

According to another characteristic of the invention, the rectilinear passage section for the product is vertical.

According to still another characteristic of the invention, the passage conduit for the product is vertical and extends in a straight line from an inlet opening for the product toward a dispensing opening for this latter.

According to still another characteristic of the invention, the motor member ensuring the movement of the actuating rod is outside the device and independent from it.

According to another characteristic of the invention, the fitting for dispensing the product is associated with a device for blowing a fluid under pressure to detach, under the influence of the blast or under the influence of vacuum or the pressure resulting from it, the tail end of the dose suspended from the dispensing fitting and promoting the fall of this tail end of the dose toward the receptacle into which has been dispensed the measurement quantity.

Thus the tail of the dosage is separated from the distribution nozzle, without employing mechanical means, solely by fluids which can be inert relative to the product to be dispensed but which can as the case may be react with them if this effect is sought. It will also be understood that the tail end of the dosage is systematically included in the dosage which guarantees precision of measurement. Moreover, there is thus ensured, after each dispensing, the cleaning of the external surfaces of the periphery of the distribution fitting, and there is thus avoided any deposition that might dry at this place which could eventually obstruct the fitting or pollute subsequent dispensing.

According to another characteristic of the invention, the fluid under pressure is blown against the tail end of the measured quantity in the form of a pulse or brief jet, of suitable intensity, to ensure rapid separation, compatible with high dispensing rates. Moreover, the power of the jet, combined with a suitable orientation in the direction of flow of the product or slightly inclined relative to this latter, permits creating a vacuum about the tail end of the measured quantity, generating a suction phenomenon for this latter, leading first of all to its separation from the dispensing fitting, and then to its controlled fall toward the receptacle.

As a modification, the direction of the jet could be radial to the fitting or slightly inclined relative to a radial plane, to ensure separation by shearing.

As a modification, the separation jet is not blown by pulses but continuously.

According to another characteristic of the invention, the blowing device is provided with a dispensing fitting for fluid under pressure and said fitting is formed about the dispensing fitting for the product.

The fluid is thus distributed about the tail end of the measured quantity, and this distribution limits the deflection of the fall of the tail end of the measured quantity toward the receptacle.

Other objects, advantages and characteristics of the invention will become apparent from a reading of the description of a preferred embodiment given by way of non-limiting example with reference to the accompanying drawings, in which.

As shown, the device according to the invention, for dispensing and precise measuring, of the order of a tenth of a milligram, of pasty products that can have a high surface tension or liquid products, semi-liquid products or else pulverulent products, that can have a high power of agglomeration, comprises a dispensing body 1 of parallel-epipedal shape, in which is formed a conduit 2 for passage of the product from an introduction opening 3 toward a dispensing fitting 4 for product in measured quantities, below which is disposed a receptacle (not shown), provided to collect the measured material dispensed by the device. The introduction opening 3 will be connected by a suitable conduit to a reservoir of product to be dispensed, this reservoir could be positioned at a higher level than the device to permit gravity flow of the product toward said device. This reservoir could also be pressurized to force the movement of the product toward the device, there could also be provided a pump between the reservoir and the device to pressurize the product in the reservoir and cause it to flow into the device.

The conduit 2, as can be seen, has a straight segment for passage of the product, which segment with respect to the direction of flow of the product, has a downstream vertical rectilinear section for passage of the product, a medial vertical rectilinear section for passage of the product. An upstream vertical rectilinear section for passage of the product is connected to said rectilinear segment. This upstream section can be laterally offset relative to the medial section and be connected to this latter by a section forming an elbow.

Figure 1:
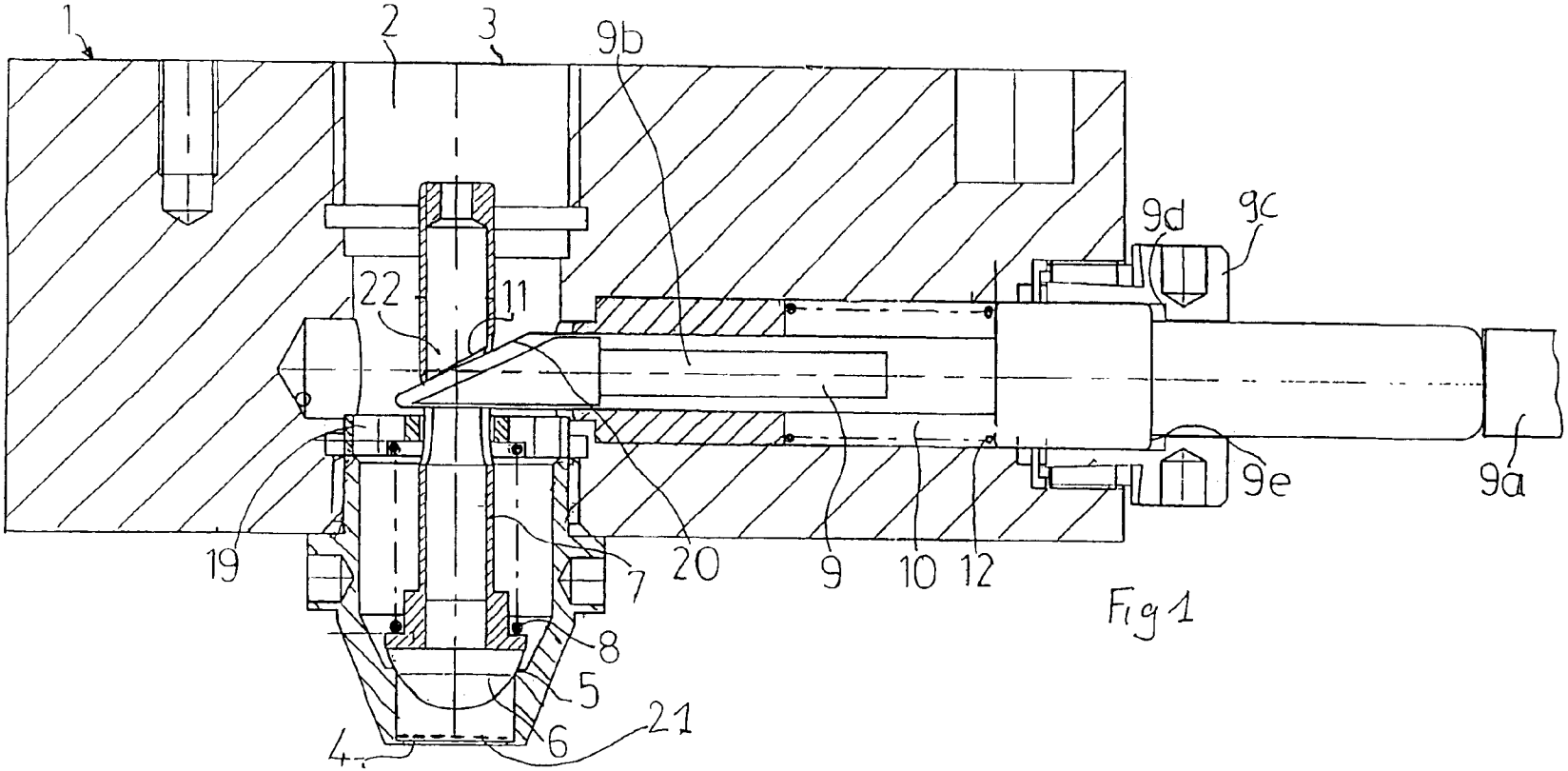
FIG. 1 is a cross-sectional view in a longitudinal medial plane, of the device according to a first embodiment.

The medial and downstream sections are in mutually axially aligned relation. The upstream section, as can be seen in FIG. 1, can also be located in axial prolongation of the medial section. In this case, the three sections are axially aligned, which minimizes pressure drop in the passage conduit for the product. It should be noted that this conduit extends vertically between the inlet opening and the dispensing opening, which facilitates the gravity flow of the product through the device.

At a slight spacing of the dispensing fitting 4, there is formed in the downstream section of the conduit 2 a valve seat 5. This seat, of truncated conical shape, is traversed by the downstream section of the conduit. As can be seen, the downstream section, downstream of the seat 5, has a diameter reduced relative to the diameter of the upstream section.

A valve 6 of hemispherical or conical form is mounted in the conduit 2 so as to be able to slide, to be applied against the seat 5 and prevent the dispensing of the product, of else to be spaced from this seat and permits its dispensing. The conduit immediately upstream of the seat 5 could have a truncated conical shape. The valve, between its closed and open positions, moves in this truncated conical region.

As can be seen, the valve 6 is provided with a vertical straight valve stem 7, extending axially in the medial section of the conduit 2, this valve stem 7 coacting with an actuating mechanism for the valve 6 by movement away from the seat 5 or toward the seat 5, this actuating mechanism penetrating at least in part into the straight passage section for the product and coming into contact with the product such that the mechanical connection between the valve stem and the actuating mechanism will also be in contact with the product and will be lubricated by the product itself.

To permit the passage of the product in the upstream section of the conduit 2, the valve stem 7 has a smaller diameter than the diameter of the conduit 2.

To ensure guidance of the valve 6, the valve stem 7 is mounted slidably in the bore axially traversing a guide socket 19, in the form of a disc, mounted blockingly in the medial section of the passage conduit. As can be seen in FIG. 1, this guide socket 19 extends transversely across the passage section and comprises, about the guide bore, through-holes for passage of the product.

Figure 2:
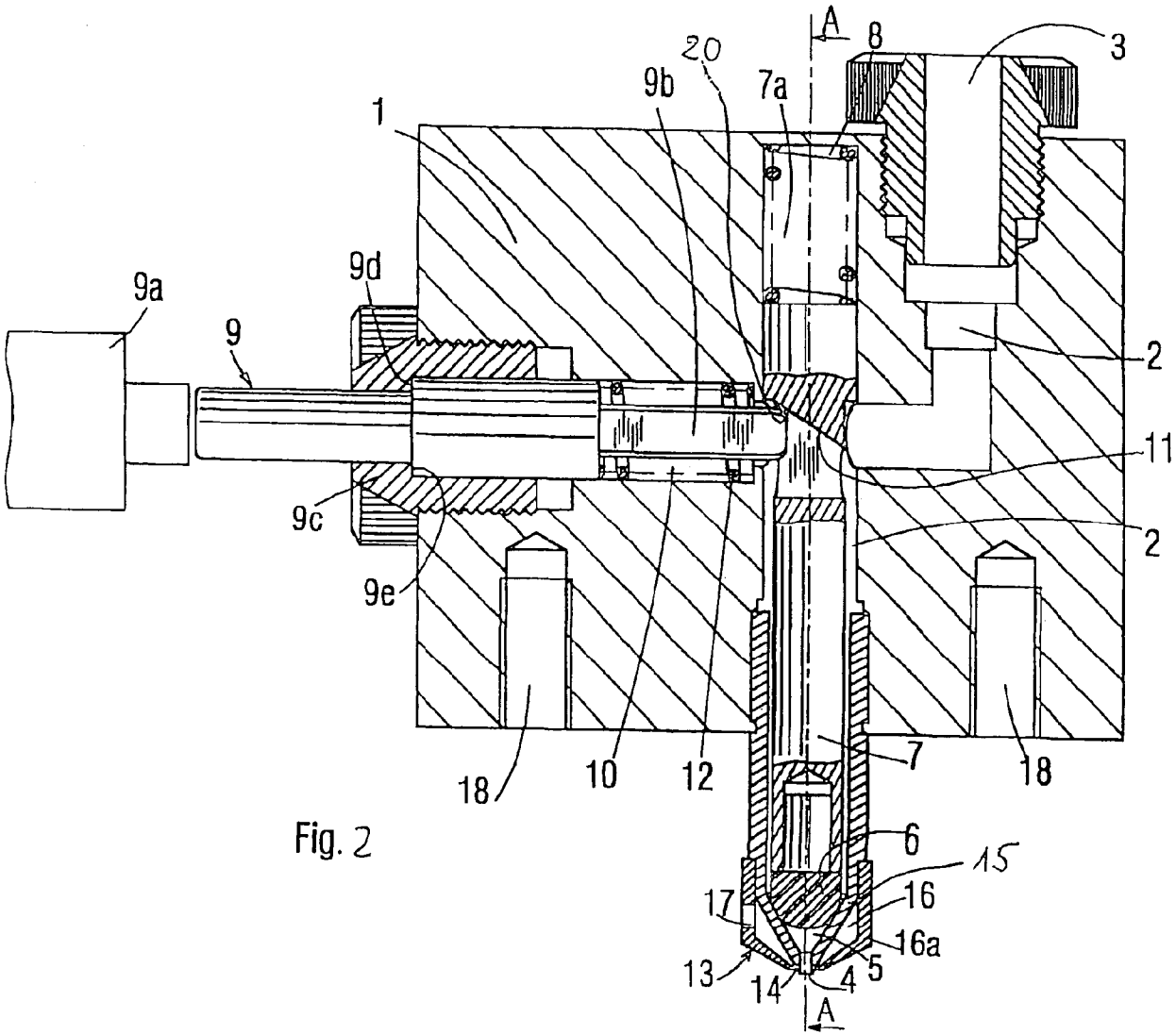
FIG. 2 is a cross-sectional view on the longitudinal medial plane of the device, according to a second embodiment.
Figure 3:
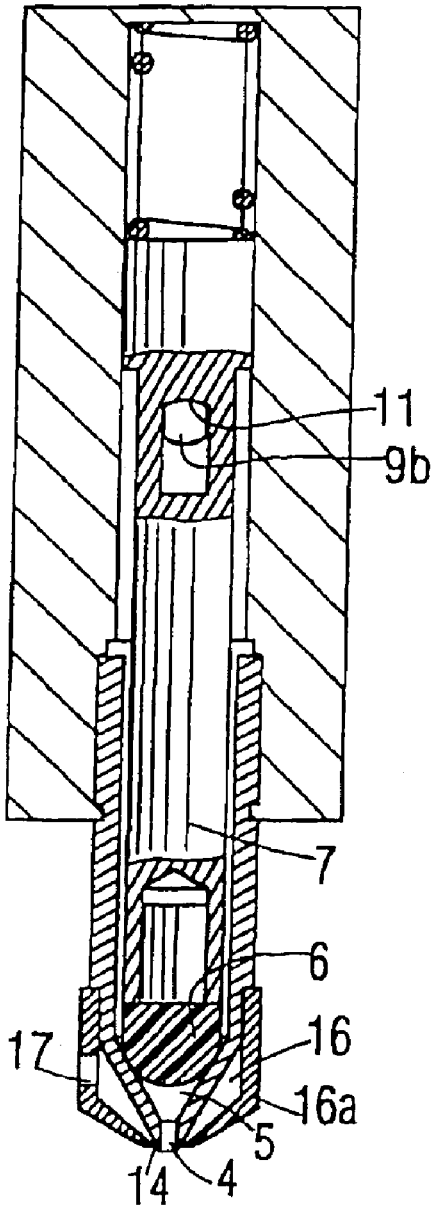
FIG. 3 is a cross-section of the device on line A-A of FIG. 2.

To ensure guidance of the valve 6, for the device according to FIGS. 2 and 3, the valve stem 7 is mounted slidably in a bore 7*a* provided in the body of the device 1, in axial prolongation of the medial section of the conduit 2. The guide bore will be sufficiently long to avoid any risk of buildup at this level. A sealing joint could be disposed in the bore 7*a* about the valve stem to avoid any reflow of product into the bore and to ensure sealing, but preferably the bore is blind, the quality of guidance of the valve stem in the bore is of the type H7-g6 for example and no sealing joint is used. The product will thus be deliberately allowed to reflow toward the bottom of the bore 7*a*, this reflow taking the place of a film whose interest is to ensure the lubrication of the guide mechanism. The quantity of reflowing product toward the bottom of the bore is very low so that this latter will fill up only very slowly. Total refilling of this bore 7*a* is not harmful per se because under the effect of the movement of the piston into the bore, a reflux movement of the product toward the conduit 2 will take place. There is thus obtained an emptying of the bore.

Pollution of the product to be dispensed by the quality of the product contained in the bore 7*a* is not to be feared because, on the one hand, the device is used only for the distribution of a single product, and, on the other hand, it is subjected to complete cleaning after each dispensing cycle.

According to a preferred embodiment of the invention, the mechanism for actuating the valve comprises, on the one hand at least one resilient member 8 of the coil spring type acting in compression against the valve 6 and urging this latter toward the seat 5 and hence toward a closed position, and on the other hand an actuating rod 9, guided axially in a bore 10 of the body of the device, which bore is transverse to the rectilinear segment of the passage conduit and opens into this segment. Preferably, this guide bore 10 is perpendicular to the medial section of the conduit 2 and opens into this latter.

The actuating rod 9 comes into contact with the valve stem 7 and acts by pressing on this latter, the contact between the valve stem and the actuating mechanism being established by two sliding surfaces 11, 20, of which 11 is provided on the valve stem 7 and the other, 20, on the actuating rod 9, the two said surfaces 11, 20 being located in the rectilinear passage segment for the product and being in contact with said product.

At least one of these surfaces is flat and oblique relative to the geometric axis of movement of the valve 6 between its open and closed positions, such that when the actuating rod 9 is moved in the direction into the body of the device, the valve 9 will be spaced from its seat under the influence of the pressure exerted by the sliding surface 20 of the rod 9 against the sliding surface 11 of the valve stem, and of course under the influence of the sliding movement of the two surfaces 11, 20 against each other. It should be noted that the movement of the valve 6 takes place against the action of the resilient member 8 on the valve 7. Thus, during reverse movement of the rod 11, the pressure of the spring 8 gives rise to movement of the valve toward the valve seat 5.

According to a first embodiment shown in FIG. 1, the resilient member 8 is mounted about the valve stem, in compression between the valve and the centering socket. According to another embodiment of the device, shown in FIGS. 2 and 3, the resilient member 8 is mounted in compression between the bottom of the bore 7*a* and the valve stem 7.

The oblique sliding surface could be provided on the actuating rod 9 or on the valve stem, the other surface being adapted to have or not have the same oblique disposition, so as to obtain contact and flat sliding of the surfaces against each other that is less subject to wear than contact and sliding in only one plane. As can be seen in FIG. 1, the two surfaces 11, 20 are both oblique.

Rod 9 is actuated to slide axially by a motor member 9*a* external to the body of the device. This rod 9 thus has a portion external to the body of the device with which the drive member 9*a* coacts with axial pressure. This drive member 9*a* can be fixed to the body of the device or else can be independent of the device and not fixed to this latter. This motor member 9*a* thus controls the movement of the rod 9 as well as its degree of entry into the bore 9. In this way, this motor member 9*a* controls the movement of the valve as well as the degree of opening of this latter. It will be understood that the valve, thanks to these means, can be disposed in a totally open position permitting the flow of the product at a maximum flow rate, but also in an intermediate position between the open and closed positions, selected according to the desired flow rate. The motor member also controls the return movement of the rod 9 and hence the way the valve is brought to closed position. This motor member will be monitored and controlled by a monitoring and control unit.

As can be seen, the movement of the rod 9 into the bore 10 toward the valve stem, takes place against the action of a resilient return member 12 mounted in compression in the bore 10 between a shoulder of this latter and a shoulder of the rod 9. In the preferred embodiment, the rod 9 has the shape of a presser finger 9*b* of reduced diameter. This form of presser finger 9*b* is provided at its end portion with one (20) of the two sliding surfaces, and the resilient return member 12, in the form of a coil spring, is mounted about this form of pressure finger. The bore 10 is formed in part by the bore passing through a removable abutment and sealing member 9*c*, engaged screwthreadedly on screwthreads of the body of device 1. The bore of this member, forms an abutment shoulder 9*d* against which will come into abutment an abutment shoulder 9*e* of the rod 9. These two shoulders limit the return movement of the rod 9. This rod, behind the mentioned shoulder, has a reduced diameter.

The oblique sliding surface forms with the geometric axis of movement of the actuator, an acute angle of a value less than 45°. Thanks to this characteristic, a given movement of the actuating rod is accompanied by a smaller movement of the valve. There is thus obtained a demultiplication effect of the movement of the valve. Thanks to this reduction effect, there is also obtained better positional precision for the valve and as a result better control of the flow rate of the product. It follows that the inclination of the sliding surfaces is compatible with the coefficient of friction on each other. It should be remembered that these two surfaces are in contact with the product such that this latter, depositing on these surfaces, forms a film adapted to decrease this coefficient of friction and as a result the wear of the two sliding surfaces.

According to the preferred embodiment, valve stem 7 is provided with a through-hole in a diametral direction, the sliding surface 11 on the valve stem being constituted by the upper surface (upstream surface with respect to the direction of flow of the product) of this hole. This hole is moreover delimited by two flat surfaces parallel to each other and parallel to the longitudinal axis of the valve stem and by a lower surface perpendicular or oblique to said axis. The pressure finger 9*b* has two parallel flats, facing the lateral surfaces of the through-hole. To ensure angular setting of the valve stem in the conduit 2 such that the sliding surface 11 always remains facing the rod 9, the pressure finger 9*b* of this latter is guided by abutment shoulders 9*b*, 9*e*, always to remain in the through-hole. The flats of this pressure finger 9*b* and the lateral surfaces of the opening, together constitute the angular setting. As can be seen in the accompanying drawings, the sliding surface 20 on the finger is oblique and faces the sliding surface 11.

Preferably, so as further to decrease the coefficient of friction of the two sliding surfaces against each other, at least one of them is covered with PTFE. It could be provided that one of these surfaces will be cut from a piece of PTFE. Also as can be seen in FIG. 1, the sliding surface 11 is formed in a wear member 22 of PTFE blocked in the valve stem 7. As can be seen, this valve stem is tubular and has in a diametral plane two opposite openings offset in height. The wear member 22 is adapted to be introduced forcibly into the valve stem and will be present in the form of a cylinder. This wear member, on one of its diameters, will be provided with the through opening mentioned above, the sliding surface 11 will always be constituted by the upper surface (upstream surface with respect to the direction of flow of the product) of this hole. During assembly, the hole of the wear member 22 will be brought to face the holes of the valve stem.

To separate from the dispensing fitting 4, the tail end of the dosage which could adhere to it under the influence of surface tension forces, there is provided a blowing device 13 for a fluid under pressure.

The fluid under pressure can be introduced into the conduit 2 downstream of the seat 5 so as to drive off by pressure the tail end of the dosage but preferably the jet of fluid under pressure delivered by the device 13 is external to the conduit 4. According to this preferred embodiment, the blowing device 13 is external to the conduit 2 and to the fitting 4.

Preferably, the fluid under pressure is blown toward the tail end of the dosage in the form of a pulse of relatively great intensity.

According to the preferred embodiment, the blowing device 13 is provided with a fitting 14 for delivering fluid under pressure. This fitting is formed about the dispensing fitting of the product such that the fluid exiting this fitting can distribute itself about the tail end of the dosage.

The dispensing fitting 4 for the product is preferably in the form of a nozzle 15, this nozzle is attached to the seat 5. Preferably the nozzle 15 is fixed removably to the body of the device 1. To this end, the nozzle 15 will be provided with a cylindrical screw-threaded portion and will be engaged by this cylindrical screw-threaded portion in a suitable tapping, provided in the body of the device about the medial section of the conduit 2. This arrangement permits removable of the valve 6 for its cleaning. In FIG. 1 it will be noted that the nozzle 15 bears against the guide socket 19 and holds this latter against a shoulder formed in the medial section of the conduit.

The nozzle 15 upstream of the dispensing opening could receive a grill 21 adapted to retain drops of liquid adapted to disturb the measurement. The nozzle 15, upstream of this grill could have a recess to tranquilize the flow.

According to another embodiment, as shown in FIGS. 2 and 3, the fitting 14 for dispensing fluid is formed by the lower circular opening of a chamber 16 formed about the nozzle 15 and delimited by an envelope 16*a* fixed relative to said nozzle. As can be seen, the envelope 16*a* and the nozzle 15 are coaxial. The envelope 16 is provided with at least one hole 17 for introduction of fluid under pressure into the chamber 16. This hole is connected by a suitable conduit of the device 13, to a source of fluid under pressure installed remotely from or adjacent to the device. On this second conduit could be installed an electrovalve controlled by a programmable computer or any other equivalent means.

As shown, the external surface of the nozzle 15 is of truncated conical shape, the small base of the truncated cone and the fitting 14 for dispensing fluid under pressure being disposed adjacent each other.

According to another embodiment, the external surface of the nozzle 15 is cylindrical-conical, the dispensing fitting 14 for the fluid under pressure being located in this case immediately adjacent the free end of the cylindrical portion. This cylindrical portion permits to a certain extent the orientation of the jet of fluid under pressure substantially along the flow axis of the product and limits the shear effect which the fluid can produce on the tail end of the dosage. The dispensing fitting for the product is provided at the end of the cylindrical portion.

Again according to the preferred embodiment, the internal surface of the envelope 16*a* has a truncated conical portion whose small base is formed by the fitting 14 for dispensing fluid under pressure. As can be seen, the truncated conical portion of the internal surface of the envelope 16*a* has a summit angle greater than the summit angle of the truncated conical portion of the external surface of the nozzle 15. This arrangement permits spacing the internal surface of the element 16*a* from the external surface of the nozzle 16 to provide a chamber 16 of sufficient volume. The summit of the cone corresponding to the truncated conical shape of the internal surface of the envelope 16 is located on the axis of symmetry of the conduit 2 adjacent the fitting 4 for dispensing the product. According to the embodiment of FIGS. 1 and 2, this summit is located downstream of this fitting so as to superpose on the tail end of the dosage a slight shearing effect. But such an embodiment should not be considered as being limiting, the summit of the cone being adapted to be located upstream of the dispensing fitting 4 for the product.

Preferably, the envelope 16*a* has a cylindrical portion in prolongation of the truncated conical portion. This cylindrical portion can be provided with at least one through hole 17, for introduction of the fluid under pressure into the chamber 16. This hole can be provided also in the truncated conical portion of the envelope. The drawings show only a single through-hole, but as a modification there could be provided several equi-spaced holes, so as better to balance the jet of fluid at the outlet of the fitting 14 and to avoid any deflection of this latter.

Preferably, the or each through-hole 17 is disposed facing the conical portion of the external surface of the nozzle 15. Again according to the preferred embodiment, the or each through-hole occupies a radial position, but this position could be inclined for example toward the dispensing fitting 14.

Preferably, the respective positions of the dispensing fittings for the product and for dispensing the fluid under pressure, are adjustable relative to each other.

To this end the envelope 16*a* of the blowing device 13 is fixed by screwing on the nozzle 15. This arrangement permits adjusting the position of the fittings in a very precise way, in the embodiment shown in the figures, the fitting 14 is slightly above the bore 4.

This possibility of adjustment permits a strict adaptation of the blowing device to the peculiarities of the product to be distributed. Thus, these respective positions could develop as a function of the physical properties of the products to be dispensed, the effect sought being the separation of the tail end of the dosage.

Preferably, the fluid used to detach the tail end of the dose from the nozzle 15 is present in the gaseous phase, this fluid being adapted to be air. As a modification, this fluid could be in liquid condition, in this case it could be liquid nitrogen.

This fluid could be in the gaseous condition at ambient temperature but as a modification, it could be present in liquid phase at ambient temperature.

There could also be used a fluid constituted by a pulverulent product.

The fluid used should be inert relative to the product to be dispensed and if desired the products already poured into the receptacle or on the contrary it could react with this or these latter according to the physical or chemical effect sought.

There has been described a device which is provided with only a single nozzle, but as a modification, this device could be provided with several nozzles, mounted coaxially in each other with spacing from each other to form annular chambers provided with circular openings forming fittings. This arrangement permits the simultaneous distribution of several products that should be associated in a same composition. According to this embodiment, the envelope 16*a* of the blowing device 13 is mounted about the most external nozzle.

The device as described is provided with holes 18 for securement to a suitable support, this support being possibly in the form of a plate. This plate could receive several devices of the type described. The device could be provided with indexing holes (not shown) adapted to coact shape-matingly with indexing fingers. Such an arrangement requires only a single motor 9*a*.

It should be noted that the external dimensional characteristics of the device as described are identical to those of the device of patent EP0 929 498 of the applicant. This particularly advantageous arrangement permits using the device according to the invention with those objects of this patent.

It follows that various components of the device according to the invention will be made from materials able to resist corrosion. Thus, there could be used stainless steel, PTFE (POLYTETRAFLUOROETHYLENE) particularly for the production of the valve, as well as other suitable materials.

The present invention provides a particularly simple solution to the problem of measuring pasty products with high surface tension, the tests carried out having demonstrated that precision of the order of a tenth of a milligram is entirely foreseeable.

It follows that the present invention can receive any arrangements and variations of the field of technical equivalents without thereby departing from the scope defined by the following claims.

What is claimed is:

1. Device for dispensing and measuring pasty, liquid, semi-liquid or pulverulent products, comprising a body (1) of the device in which is formed a conduit (2) for passage of the product from an inlet opening (3) for the product toward a fitting (4) for dispensing the product in measured quantities, a valve seat (5) being formed in said conduit (2) and a valve (6) being mounted in said conduit so as to be able to slide and be applied against the valve seat (5) to prevent the dispensing of the product or to be spaced from said seat (5) to permit the dispensing of the product, the valve (6) being provided with a valve stem (7) mounted slidably in a guide bore **(7*a*) and coacting with a motor mechanism for actuating the valve (6) to move it toward and away from the valve seat (5), the conduit (2) for passage of the product comprises a rectilinear segment for passage of the product in which segment is disposed the valve seat and through which extend axially and in totality the valve (6) and the valve stem (7) and into which segment penetrates at least a portion of the actuating mechanism of the valve, this mechanism being in contact with the product such that the mechanical connection between the valve stem (7) and the actuating mechanism will also be in contact with the product and will be lubricated by the product itself characterized in that the actuating mechanism for the valve (6) comprises on the one hand at least one resilient member (8) acting by pushing on the valve (6) and urging this latter toward the seat (5) and hence toward a closed position and on the other hand an actuating rod (9) guided axially in a bore (10) of the body of the device, which bore is transverse to the rectilinear segment of the passage conduit and opens into said segment, said rod (9) coming into contact with the valve stem (7) to act by pressing this latter, the contact between the valve stem (7) and the actuating member being established by two sliding surfaces (11, 20) of which one (11) is provided on the valve stem (7) and the other (20) on the actuating rod (9), the two said surfaces (11, 20) being located in the rectilinear segment of the passage for the product, and at least one of said surfaces being flat and oblique relative to the geometric axis of movement of the valve (6) between its open and closed positions and oblique relative to the axis of movement of the actuating rod (9), such that when the actuating rod (9) is moved by a motor member (9*a*) in the direction of moving into the body of the device, the valve (6) will be spaced from its seat (5) under the force of the pressure exerted by the sliding surface of the actuating rod (9) on the sliding surface of the valve stem (7)**.

2. Device for dispensing and measuring pasty, liquid, semi-liquid or pulverulent products according to claim 1, characterized in that the oblique sliding surface (11) and/or (20) forms with the geometric axis of movement of the actuating rod (9) an acute angle of a value less than 45°.

3. Device for dispensing and measuring pasty, liquid, semi-liquid or pulverulent products according to claim 1, characterized in that the guide bore (10) for the actuating rod (9) is perpendicular to the passage section for the product.

4. Device for dispensing and measuring pasty, liquid, semi-liquid or pulverulent products according to claim 1, characterized in that the rectilinear section for passage of the product is vertical.

5. Device for dispensing and measuring pasty, liquid, semi-liquid or pulverulent products according to claim 1, characterized in that the conduit (2) for passage of the product is vertical and extends in a rectilinear manner from an inlet opening (3) for the product toward a dispensing opening (4) for this latter.

6. Device for dispensing and measuring pasty, liquid, semi-liquid or pulverulent products according to claim 1, characterized in that the drive motor **(9*a*) ensuring the movement of the actuating rod (9)** is external to the device and independent of this latter.

7. Device for dispensing and measuring pasty, liquid, semi-liquid or pulverulent products according to claim 1, characterized in that with the fitting (4) for dispensing the product is associated a device (13) for blowing a fluid under pressure to detach, under the effect of the blowing or under the effect of the suction or under the effect of the resulting pressure, the tail end of the dosage attached to the dispensing fitting (4).

8. Device for dispensing and measuring pasty, liquid, semi-liquid or pulverulent products according to claim 7, characterized in that the fluid under pressure is blown toward the tail end of the dosage in the form of an impulse.

9. Device for dispensing and measuring pasty, liquid, semi-liquid or pulverulent products according to claim 7, characterized in that the fluid under pressure is introduced into the conduit (2) downstream of the seat (5).

10. Device for dispensing and measuring pasty, liquid, semi-liquid or pulverulent products according to claim 7, characterized in that the jet of fluid under pressure delivered by the device (13) is external to the conduit (4).

11. Device for dispensing and measuring pasty, liquid, semi-liquid or pulverulent products according to claim 10, characterized in that the blowing device (13) is provided with a fitting (14) for dispensing of fluid under pressure and that said fitting (14) is formed about the fitting (4) for dispensing the product.

12. Device for dispensing and measuring pasty, liquid, semi-liquid or pulverulent products according to claim 11, characterized in that the fitting (4) for dispensing the product is formed in a nozzle (15) and that the fitting (14) for dispensing, the fluid is formed by a circular opening of an envelope **(16*a*) delimiting a chamber (16) about the nozzle (15)**.

13. Device for dispensing and measuring pasty, liquid, semi-liquid or pulverulent products according to claim 11, characterized in that the external surface of the nozzle (15) is of truncated conical shape, the small base of the truncated cone and the fitting 14 for dispensing fluid under pressure being disposed adjacent each other.

14. Device for dispensing and measuring pasty, liquid, semi-liquid or pulverulent products according to claim 11, characterized in that the external surface of the nozzle (15) is of cylindro-conical shape, the fitting (14) for dispensing the fluid under pressure being located immediately adjacent the free end of the cylindrical portion.

15. Device for dispensing and measuring pasty, liquid, semi-liquid or pulverulent products according to claim 13, characterized in that the internal surface of the envelope 16*a* has a truncated conical portion whose small base is formed by the fitting 14 for dispensing fluid under pressure.

16. Device for dispensing and measuring pasty, liquid, semi-liquid or pulverulent products according to claim 15, characterized in that the summit of the cone corresponding to the truncated conical shape of the internal surface of the envelope (16) is located on the axis of symmetry of the conduit (2) adjacent the fitting (4) for dispensing the product.

17. Device for dispensing and measuring pasty, liquid, semi-liquid or pulverulent products according to claim 12, characterized in that the wall of the envelope (16*a*) is provided with at least one hole (17) for introduction into the chamber (16) of the fluid under pressure.

18. Device for dispensing and measuring pasty, liquid, semi-liquid or pulverulent products according to claim 12, characterized in that the nozzle (15) is fixed by screwing in the body of the device.

19. Device for dispensing and measuring pasty, liquid, semi-liquid or pulverulent products according to claim 1, characterized in that the respective positions of the fittings (4) for dispensing product and for dispensing fluid (14) under pressure are adjustable relative to each other.

20. Device for dispensing and measuring pasty, liquid, semi-liquid or pulverulent products according to claim 11, characterized in that the chamber (16) of the blowing device for air is fixed by screwing on the nozzle (15).

21. Device for dispensing and measuring pasty, liquid, semi-liquid or pulverulent products according to claim 1, characterized in that the fluid used to detach the tail end of the dosage from the nozzle (15) is present in the gaseous condition.

22. Device for dispensing and measuring pasty, liquid, semi-liquid or pulverulent products according to claim 7, characterized in that the fluid used to detach the tail end of the dosage from the nozzle is present in the liquid condition.

23. Device for dispensing and measuring pasty, liquid, semi-liquid or pulverulent products according to claim 1, characterized in that the fluid used to detach the tail end of the dosage from the nozzle is present in the gaseous condition at ambient temperature.

24. Device for dispensing and measuring pasty, liquid, semi-liquid or pulverulent products according to claim 7, characterized in that the fluid used to detach the tail end of the dosage from the nozzle is present in the liquid condition at ambient temperature.

25. Device for dispensing and measuring pasty, liquid, semi-liquid or pulverulent products according to claim 12, characterized in that it is provided with several nozzles mounted coaxially of each other, spaced from each other, to form annular chambers provided with circular openings forming a fitting, and that the envelope 16*a* of the blowing device 13 is mounted about the outermost nozzle.

* * * * *